US010280888B2

(12) United States Patent
Fuchs

(10) Patent No.: US 10,280,888 B2
(45) Date of Patent: May 7, 2019

(54) SOLENOID VALVE FOR A FUEL INJECTION SYSTEM, AND HIGH PRESSURE FUEL PUMP

(71) Applicant: CONTINENTAL AUTOMOTIVE GMBH, Hannover (DE)

(72) Inventor: Thomas Fuchs, Fladungen (DE)

(73) Assignee: CPT Group GmbH, Hannover (DE)

( * ) Notice: Subject to any disclaimer, the term of this patent is extended or adjusted under 35 U.S.C. 154(b) by 0 days.

(21) Appl. No.: 15/857,662

(22) Filed: Dec. 29, 2017

(65) Prior Publication Data

US 2018/0195481 A1 Jul. 12, 2018

(30) Foreign Application Priority Data

Jan. 10, 2017 (EP) ..... 17150743

(51) Int. Cl.

| | |
|---|---|
| ***F02D 41/40*** | (2006.01) |
| ***F02M 47/02*** | (2006.01) |
| ***F02M 59/36*** | (2006.01) |
| ***F02M 59/46*** | (2006.01) |
| ***F02M 63/00*** | (2006.01) |

(52) U.S. Cl.

CPC ..... *F02M 63/0019* (2013.01); *F02D 41/406* (2013.01); *F02M 47/027* (2013.01); *F02M 59/365* (2013.01); *F02M 59/464* (2013.01); *F02M 63/0021* (2013.01); *F02M 63/0033* (2013.01); *F02M 63/0071* (2013.01); *F02M 63/0075* (2013.01); *F02M 63/0077* (2013.01); *F02M 63/0078* (2013.01); *F02D 2200/0602* (2013.01); *F02D 2250/31* (2013.01); *F02M 2200/02* (2013.01); *F02M 2200/09* (2013.01); *F02M 2200/40* (2013.01)

(58) Field of Classification Search

CPC ..... F02M 63/0019; F02M 63/0021; F02M 63/0033; F02M 63/0071; F02M 63/0075; F02M 63/0077; F02M 63/0078; F02M 47/027; F02M 59/365; F02M 59/464; F02D 41/406

USPC ..... 123/490, 495

See application file for complete search history.

(56) References Cited

U.S. PATENT DOCUMENTS

| | | | | |
|---|---|---|---|---|
| 2013/0134335 | A1* | 5/2013 | Wirkowski | F02D 41/20 251/129.01 |
| 2016/0076501 | A1* | 3/2016 | Maess | F02D 41/20 123/458 |
| 2017/0023165 | A1* | 1/2017 | Fujita | F04B 39/0033 |

FOREIGN PATENT DOCUMENTS

| | | | |
|---|---|---|---|
| EP | 1667177 | A1 | 6/2006 |
| EP | 2497937 | A1 | 9/2012 |
| EP | 2574768 | A1 | 4/2013 |
| EP | 2653712 | A1 | 10/2013 |

(Continued)

OTHER PUBLICATIONS

European Patent Office Search Report dated Sep. 11, 2017 for corresponding European patent application No. 17150743.7.

(Continued)

*Primary Examiner* — Mahmoud Gimie

(57) ABSTRACT

There is disclosed a solenoid valve for a fuel injection system, in which solenoid valve a closing element which interacts with a valve seat in order to close and open the solenoid valve is actuated by a control pin, the control pin being formed by way of a solenoid plunger. Furthermore, a high pressure fuel pump is disclosed which has a solenoid valve of this type.

16 Claims, 4 Drawing Sheets

(56) References Cited

FOREIGN PATENT DOCUMENTS

| | | | |
|---|---|---|---|
| JP | H10306761 | A | 11/1998 |
| JP | 2015108409 | A | 6/2015 |
| JP | 2015218675 | A | 12/2015 |
| JP | 2016142143 | A | 8/2016 |
| WO | 2013092892 | A1 | 6/2013 |
| WO | 2016055267 | A1 | 4/2016 |

OTHER PUBLICATIONS

Japanese Office Aciton dated Sep. 26, 2018 for corresponding Japanese patent application No. 2018-001338.

* cited by examiner

SOLENOID VALVE FOR A FUEL INJECTION SYSTEM, AND HIGH PRESSURE FUEL PUMP

CROSS REFERENCE TO RELATED APPLICATION

This application claims the benefit of European application No. 17150743.7, filed Jan. 10, 2017, which is hereby incorporated by reference.

FIELD OF INVENTION

The invention relates to a solenoid valve for a fuel injection system of an internal combustion engine, and to a high pressure fuel pump which has a solenoid valve of this type.

BACKGROUND

In fuel injection systems in internal combustion engines, a fuel is usually loaded with a high pressure, the pressure lying, for example, in a range of from 150 bar to 400 bar in gasoline internal combustion engines and in a range of from 1500 bar to 2500 bar in diesel internal combustion engines. The higher the pressure which can be generated in the respective fuel, the lower the emissions which are produced during the combustion of the fuel in a combustion chamber, which is advantageous, in particular, against the background that a reduction in emissions is desired to an ever greater extent.

In the fuel injection system, valve arrangements can be provided at different positions of the path taken by the fuel from a tank to the respective combustion chamber of the internal combustion engine, for example as volumetric flow regulating valves which are used, for example, in high pressure gasoline fuel pumps which are configured as a reciprocating piston pump, in order to vary the degree of delivery of the fuel by way of the high pressure fuel pump by way of targeted variation of the closing and opening time relative to a position of the reciprocating piston of the high pressure fuel pump. Said volumetric flow regulating valves are frequently configured as solenoid valves and have a valve seat and a movably mounted closing element. Here, the closing element is moved via an actuator region which comprises a movable armature which can be moved relative to a pole piece by means of electromagnetic forces. At least one of the positions of the solenoid valve (open or closed) can be brought about or maintained in an active manner for a defined time period by way of the position of the armature.

In order that the armature can be moved by means of electromagnetic force, the armature comprises a ferromagnetic material or consists completely of a material of this type, and has a mass which is subject to the laws of inertia. On account of this fact, switching of the valve takes place with a certain time delay in relation to the start of the actuation of the solenoid valve. It is desirable to reduce said time delay to a minimum, in order to achieve a satisfactory regulating capability, in particular at high reciprocating frequencies. Furthermore, the armature often comes into contact with other components in at least one end position. In a manner which is dependent on the momentum which is linked directly to the mass of the armature via the velocity, mechanical oscillations are generated during the contact of the armature, which mechanical oscillations lead firstly to material wear, but secondly also to an undesired emission of solid-borne noise. It is therefore desirable to keep the moving masses as low as possible by way of structural measures.

SUMMARY

It is therefore an object of the invention to reduce an armature mass in a solenoid valve for a fuel injection system.

An example embodiment includes a high pressure fuel pump in a fuel injection system, which high pressure fuel pump has a solenoid valve of this type.

A solenoid valve for a fuel injection system has a valve region with a closing element and a valve seat which interact in order to close the solenoid valve. Furthermore, the solenoid valve includes an actuator region with a control pin for moving the closing element along a movement axis into an open or closed position. The actuator region has a stationary pole piece with a pole piece bore which is arranged in the pole piece, and a solenoid plunger which may be moved relative to the pole piece along the movement axis and is arranged with a pole piece end in the pole piece bore in a contactless manner with respect to the pole piece. Here, the solenoid plunger forms the control pin.

It has been known up to now that the armature is configured as a movable block which is connected or coupled in some other way to the control pin, the control pin in turn acting on the closing element of the solenoid valve. Here, the block-shaped armature has a very great mass in comparison with the control pin, very high magnetic forces being necessary, in order to maintain the required switching times of the solenoid valve in the case of said high mass.

It is therefore now proposed to not configure the armature as a block-shaped element, but rather as a solenoid plunger. In order to further save mass, said solenoid plunger at the same time forms the control pin which moves the closing element along the movement axis. The control pin is therefore at the same time the solenoid plunger. The moving masses may be reduced to a minimum by way of the configuration of the armature in accordance with the solenoid plunger principle, the solenoid plunger at the same time forming the control pin. On account of the lower moving masses, the momentum during contact in an end position may be reduced, which leads to a lower development of noise and at the same time also lowers the material loading. Moreover, lower switching times may be achieved on account of the reduced masses to be moved.

The valve region advantageously has a valve seat plate which forms the valve seat. Here, the closing element is configured as a small plate which lies on the valve seat plate in the closed position of the solenoid valve. Here, the pole piece and the small plate are arranged, in particular, on opposite sides of the valve seat plate.

A refinement of this type of the solenoid valve is particularly advantageous if the solenoid valve is to be operated as a normally open solenoid valve, in which the closing element advantageously does not lie on the valve seat or the valve seat plate in the non-energized state, but rather is held away from said valve seat or the valve seat plate. If the closing element is additionally configured as a lightweight small plate, the momentum during contact of the small plate with the valve seat may also advantageously be reduced considerably here in comparison with a closing element having a greater mass such as, for example, a ball valve or a mushroom-headed valve.

If the solenoid plunger is advantageously configured as a cylindrical pin which penetrates the valve seat plate with a valve seat plate end in a contactless manner, it may advantageously press the closing element (for example, in the form of the small plate) away from the valve seat by way of simple contact, and does not have to be connected fixedly to the closing element to this end. As a result, the mass both of the closing element and of the solenoid plunger are once again reduced, since the two elements do not have a fixed connection to one another.

The closing element which is configured as a small plate is advantageously connected fixedly to the valve seat plate and is of flexible configuration only in regions, with the result that the closing element opens valve openings when it is actuated by the solenoid plunger. As a result, a displacement of the small plate out of its position may be prevented.

A stop for limiting the movement travel of the solenoid plunger along the movement axis is advantageously configured on the solenoid plunger. As a result, the movement of the solenoid plunger may advantageously be limited in one direction.

Here, a single stop may be provided in one movement direction of the solenoid plunger, but a plurality of stops which define two opposite end positions of the solenoid plunger may also be provided.

Here, in one exemplary embodiment, the stop is configured at a pole piece end of the solenoid plunger for interaction with the pole piece. This means that that end of the solenoid plunger, which is arranged such that it is oriented toward the pole piece, has the stop.

In one alternative refinement, however, the stop may also be configured such that it lies opposite at a valve seat plate end of the solenoid plunger, and may thus interact with the valve seat plate, in order to limit the movement travel of the solenoid plunger.

In a further advantageous refinement, it is possible to not provide the stop on the solenoid plunger itself at all, but rather in a separate manner from the latter, for example in the pole piece bore in the form of a stop pin which limits the movement travel of the solenoid plunger in the pole piece bore.

A restoring spring is preferably provided, in order to prestress the solenoid plunger into a starting position. Here, for example, the starting position is an open position of the solenoid valve, in which open position the solenoid plunger holds the closing element away from the valve seat.

The magnetic forces of the actuator region then act in a manner which is just so strong as to overcome the spring force of the restoring spring and, for example, to pull the solenoid plunger into a position, in which the closing element returns onto the valve seat.

In one advantageous refinement, the restoring spring is arranged within the pole piece bore. It is possible by way of a refinement of this type to utilize installation space twice, namely firstly as a pole piece bore, into which the solenoid plunger dips or extends, but secondly also as installation space for the restoring spring itself.

In one alternative refinement, the restoring spring is arranged outside the pole piece bore and is supported, for example, on a stop on the solenoid plunger and on the pole piece. It is possible in an arrangement of this type to use a larger spring with a greater spring force.

If, in one preferred embodiment, the stop is not configured directly on the solenoid plunger, but is rather configured as a stop pin within the pole piece bore, it is preferred if the restoring spring is arranged around the stop pin, in order thus to save installation space.

In one embodiment, in which the restoring spring is arranged outside the pole piece bore, the stop may also be arranged on the solenoid plunger in such a way that it is situated neither at the pole piece end of the solenoid plunger nor at the valve seat plate end of the solenoid plunger, but rather centrally in between them. In this case, the spring is supported on the pole piece and the stop in such a way that the stop does not come into contact with the pole piece during operation at any operating point.

In one advantageous refinement, the solenoid valve is configured as a volumetric flow regulating valve.

A high pressure fuel pump for a fuel injection system of an internal combustion engine preferably has an above-described solenoid valve.

For example, a solenoid valve of this type may be configured as a volumetric flow regulating valve, in particular as an inlet valve of the high pressure fuel pump.

BRIEF DESCRIPTION OF THE DRAWINGS

Advantageous refinements of the invention will be described in greater detail in the following text using the appended drawings, in which.

DETAILED DESCRIPTION

Figure 1:
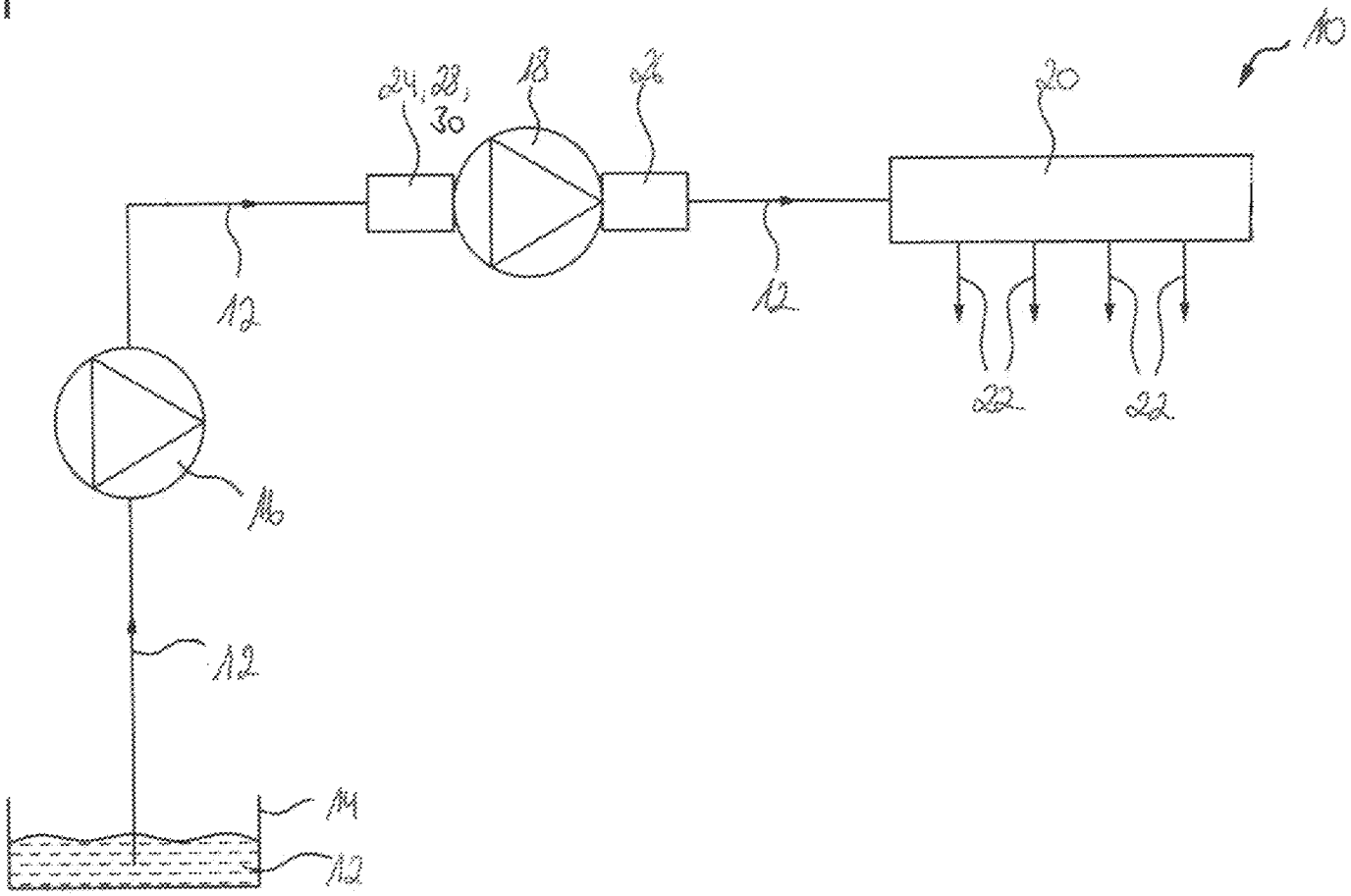
FIG. 1 shows a diagrammatic overview illustration of a fuel injection system having a high pressure fuel pump, on which a solenoid valve is arranged as inlet valve.

FIG. 1 shows a diagrammatic overview illustration of a fuel injection system 10 of an internal combustion engine, which fuel injection system 10 delivers fuel 12 from a tank 14 via a pre-feed pump 16, a high pressure fuel pump 18 and a high pressure fuel accumulator 20 to injectors 22 which then inject the fuel 12 into combustion chambers of the internal combustion engine.

The fuel 12 is introduced via an inlet valve 24 into the high pressure fuel pump 18, is led out of the high pressure fuel pump 18 via an outlet valve 26 in a manner which is loaded with pressure, and is fed to the high pressure fuel accumulator 20.

The inlet valve 24 is configured as a solenoid valve 28, in particular as a volumetric flow regulating valve 30, and may therefore regulate the degree of delivery of fuel 12 in the high pressure fuel pump 18 in an active manner by way of the targeted variation of a closing and opening time.

The solenoid valve 28 is shown in greater detail in each case in a diagrammatic sectional illustration in different embodiments in FIG. 2 to FIG. 7.

Figure 2:
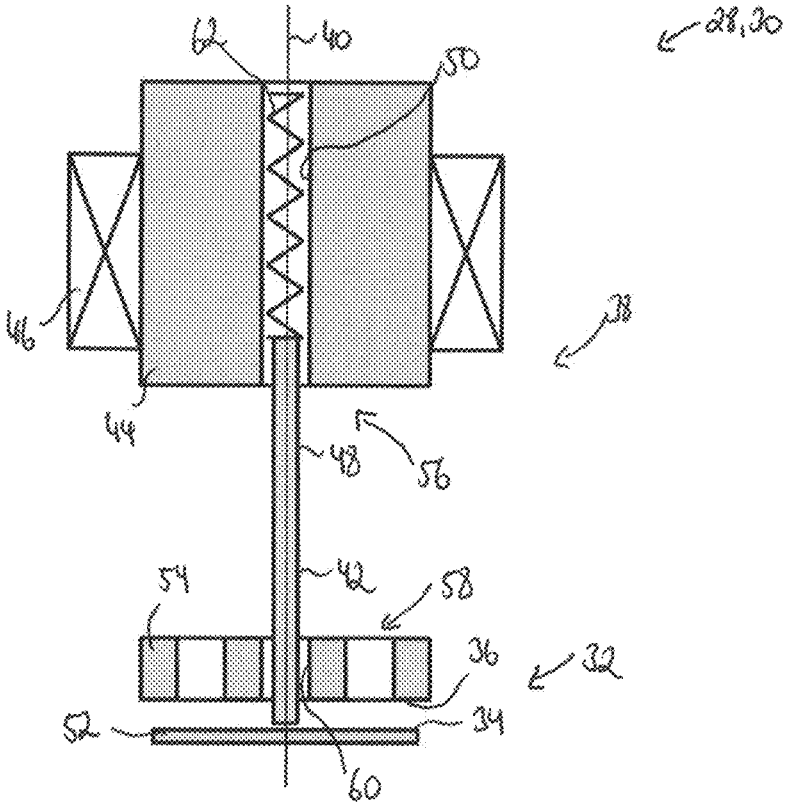
FIG. 2 shows a diagrammatic sectional illustration through the solenoid valve from FIG. 1 in a first embodiment.

Reference is made first of all to FIG. 2 in the following text.

The solenoid valve 28 has a valve region 32 with a closing element 34 and a valve seat 36, and an actuator region 38 which ensures that the closing element 34 may be moved along a movement axis 40.

To this end, the actuator region 38 comprises a control pin 42 which is coupled to the closing element 34. In the present embodiment, said coupling takes place without a fixed connection, with the result that the control pin 42 makes contact with the closing element 34 only when the closing element 34 is to be moved.

The control pin 42 is moved along the movement axis 40 by virtue of the fact that it interacts with a stationary pole piece 44 when a coil 46 induces a magnetic field in the actuator region 38. Here, the control pin 42 is configured at the same time as a solenoid plunger 48, and dips into a pole piece bore 50 which is arranged centrally in the pole piece 44. The solenoid plunger 48 then moves along the movement axis 40 by way of magnetic interaction of the solenoid plunger 48 and the pole piece 44.

In all the embodiments which are shown in FIG. 2 to FIG. 7, the closing element 34 is configured as a small plate 52 and is arranged so as to lie opposite the pole piece 44 with regard to a valve seat plate 54, on which the valve seat 36 is formed. The control pin 42, which at the same time forms the solenoid plunger 48, is configured as a cylindrical pin, and dips into the pole piece bore 50 with a pole piece end 56 which is arranged such that it is directed toward the pole piece 44. Said control pin 42 at the same time engages with a valve seat plate end 58 through a through opening 60 in the valve seat plate 54, in order thus to be capable of coming into contact with the closing element 34.

Furthermore, the actuator region 38 has a restoring spring 62 which prestresses the control pin 42 into a starting position, the starting position being an open position of the solenoid valve 28 in all the embodiments which are shown. Therefore, the solenoid valve 28 is configured as a normally open solenoid valve 28 in the present embodiments. It is also conceivable, however, to configure the solenoid valve 28 as a normally closed solenoid valve 28, the starting position of the control pin 42 then being such that the small plate 52 lies on the valve seat plate 54.

It is also conceivable to provide other valve forms in the valve region 32, that is to say a ball valve or other forms instead of the small plate 52, and it is also conceivable that the closing element 34 is also not arranged so as to lie opposite the pole piece 44 with regard to the valve seat plate 54, but rather is arranged on the same side.

In the case of known solenoid valves 28 in fuel injection systems 10, solenoid plungers 48 are normally not used, but rather the armature is formed as a block element and is coupled to the control pin 42.

It is now proposed in the present case, however, to combine the functions of the control pin 42 and the normally provided block-shaped armature in the form of a solenoid plunger 48, in order thus to save mass, in particular, on the separately provided armature which is now no longer present.

This results overall in a lower moving mass, which leads to momentum when coming into contact in an end position being reduced, which leads to a lower development of noise. In addition, this has the advantage that the coil 46 and/or the associated electromagnet and also possibly the restoring spring 62 may be of smaller and therefore less expensive design on account of the lower forces which act, since lower forces are necessary for acceleration. Furthermore, lower switching times than up to now may be achieved.

FIG. 3 to FIG. 7 show variations of the solenoid valve 28 in the first embodiment which was described in relation to FIG. 2; in each case only the differences are to be described in the following text.

Figure 3:
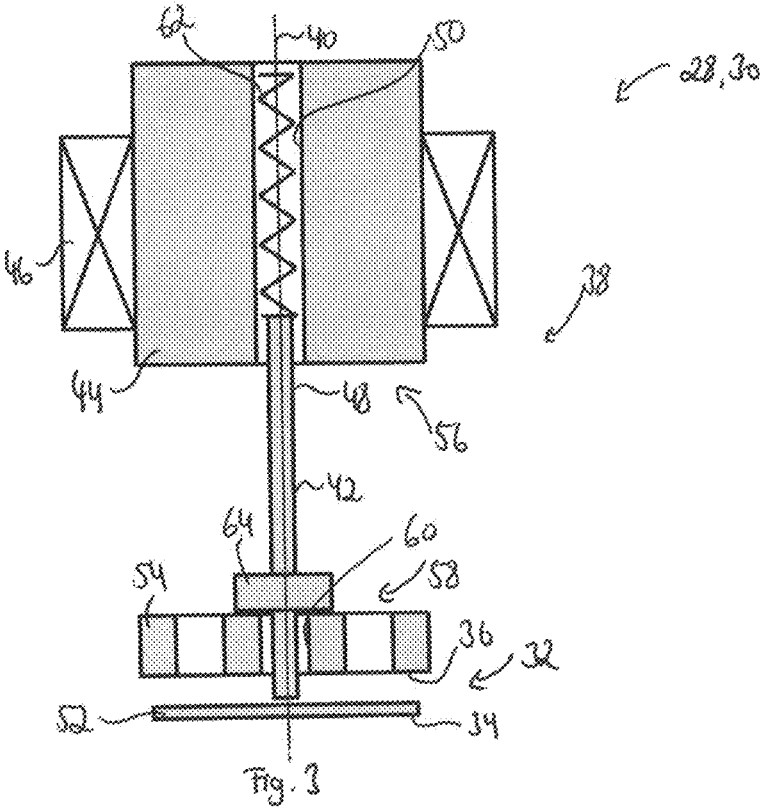
FIG. 3 shows a diagrammatic sectional illustration through the solenoid valve from FIG. 1 in a second embodiment.

FIG. 3 shows a diagrammatic sectional illustration of a second embodiment of the solenoid valve 28, a stop 64 which is configured on the solenoid plunger 48 and is situated, in particular, at the valve seat plate end 58 of the solenoid plunger 48 now being provided in contrast to the first embodiment. Said stop 64 limits the movement travel of the solenoid plunger 48 in the direction of the open position, in which the small plate 52 is pressed away from the valve seat 36.

Figure 4:
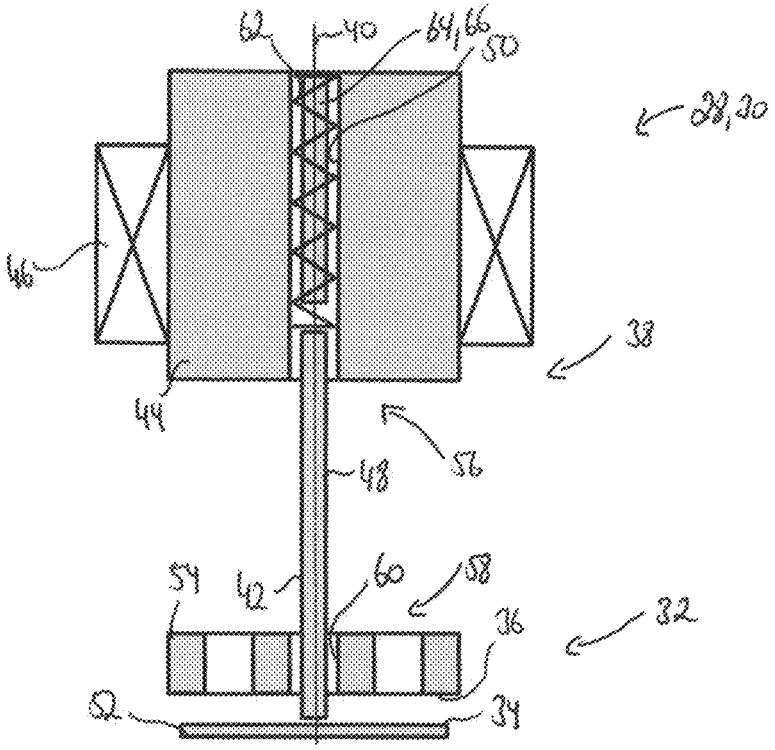
FIG. 4 shows a diagrammatic sectional illustration through the solenoid valve from FIG. 1 in a third embodiment.

FIG. 4 shows a diagrammatic sectional illustration of a third embodiment of the solenoid valve 28, in which the stop 64 is not configured on the solenoid plunger 48 itself, but rather is arranged separately from the solenoid plunger 48 in the pole piece bore 50, to be precise within the restoring spring 62 which is situated in the pole piece bore 50. Here, the stop 64 is formed as a stop pin 66.

Figure 5:
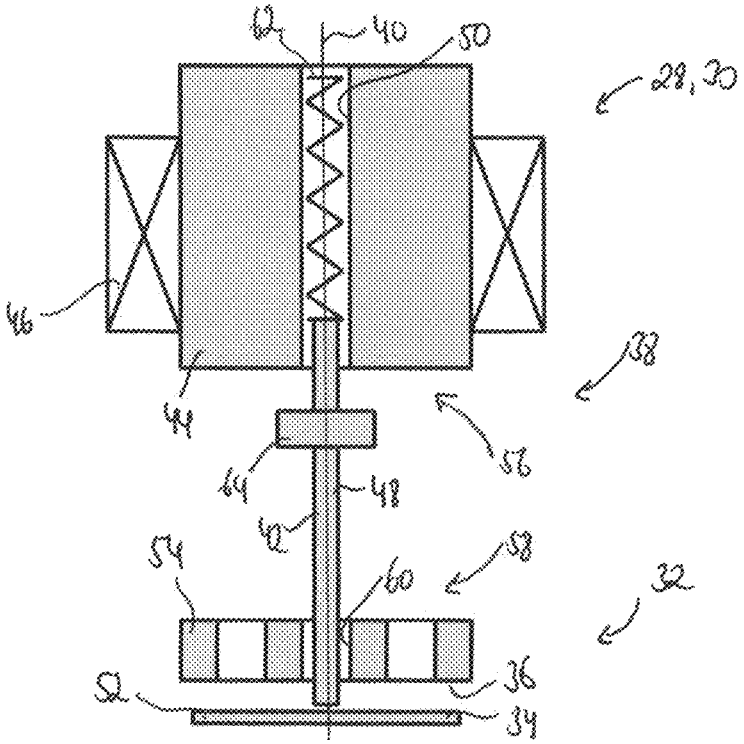
FIG. 5 shows a diagrammatic sectional illustration through the solenoid valve from FIG. 1 in a fourth embodiment.

FIG. 5 shows a diagrammatic sectional illustration of a fourth embodiment of the solenoid valve 28, which fourth embodiment corresponds to the second embodiment in FIG. 3, it merely being the case that the stop 64 is not configured (as shown in FIG. 3) at the valve seat plate end 58, but rather at the pole piece end 56 of the solenoid plunger 48. This means that the movement travel of the solenoid plunger 48 in the direction of the closed position of the solenoid valve 28 is limited here, by an interaction taking place between the pole piece 44 and the stop 64.

Figure 6:
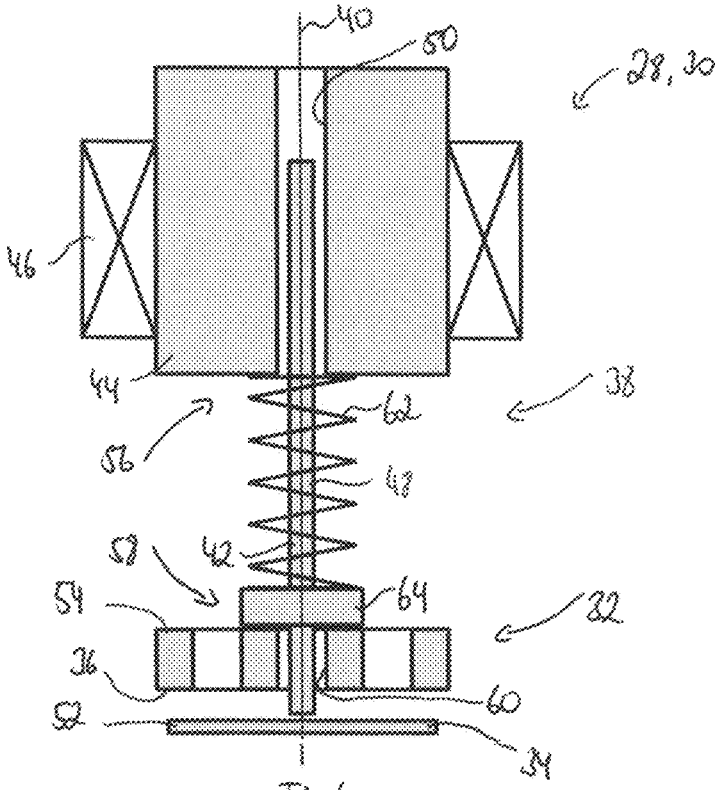
FIG. 6 shows a diagrammatic sectional illustration through the solenoid valve from FIG. 1 in a fifth embodiment.

FIG. 6 shows a diagrammatic sectional illustration of a fifth embodiment of the solenoid valve 28, in which fifth embodiment the restoring spring 62 is not arranged within the pole piece bore 50 (as in the first four embodiments), but rather is arranged outside the pole piece bore 50 and is supported on one side on the stop 64 and on the other side on the pole piece 44.

Figure 7:
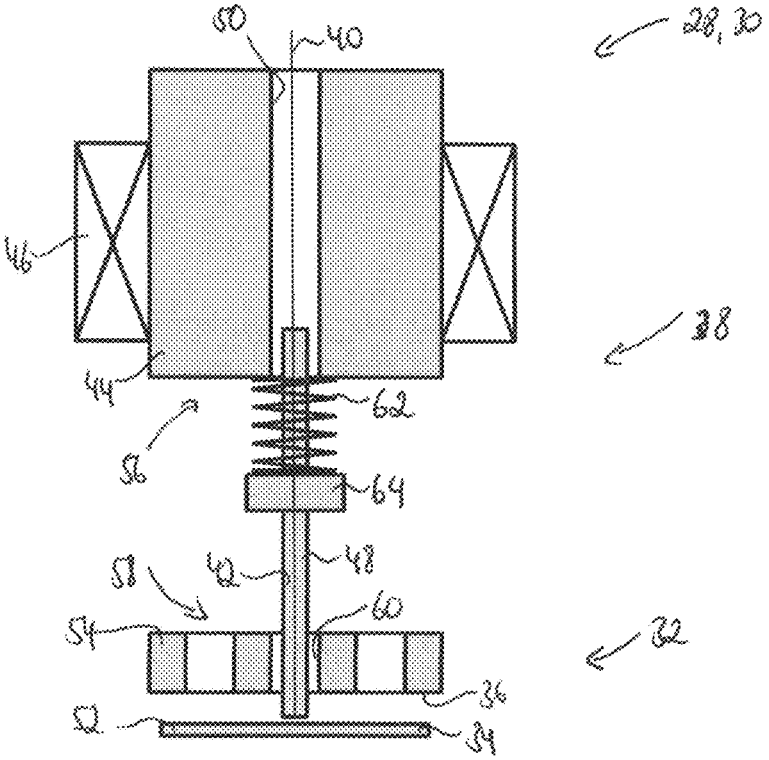
FIG. 7 shows a diagrammatic sectional illustration through the solenoid valve from FIG. 1 in a sixth embodiment.

FIG. 7 shows a diagrammatic sectional illustration of a sixth embodiment which corresponds to the embodiment in FIG. 6, it merely being the case that the stop 64 is not situated at an end, namely the valve seat plate end 58 of the solenoid plunger 48, but rather is situated centrally, with the result that the stop 64 comes into contact neither with the valve seat plate 54 nor with the pole piece 44, but rather is coupled to the pole piece 44 for travel limiting merely via the restoring spring 62.

The invention claimed is:

1. A solenoid valve for a fuel injection system, comprising:

a valve region with a closing element and a valve seat which interact in order to close the solenoid valve;

an actuator region with a control pin for moving the closing element along a movement axis into an open or closed position, the actuator region having a stationary pole piece with a pole piece bore which is arranged in the pole piece, and a solenoid plunger which is movable relative to the pole piece along the movement axis and is arranged with a pole piece end in the pole piece bore in a contactless manner with respect to the pole piece, the solenoid plunger forming the control pin; and a stop pin, separate from the solenoid plunger and the valve seat, for limiting movement travel of the solenoid plunger along the movement axis, the stop pin is arranged in a fixed position in the pole piece bore.

2. The solenoid valve as claimed in claim 1, wherein the valve region has a valve seat plate which forms the valve seat, the closing element being configured as a small plate which lies on the valve seat plate in the closed position of the solenoid valve, the pole piece and the small plate being arranged on opposite sides of the valve seat plate.

3. The solenoid valve as claimed in claim 2, wherein the solenoid plunger is configured as a cylindrical pin which penetrates the valve seat plate with a valve seat plate end in a contactless manner.

4. The solenoid valve as claimed in claim 1, further comprising a restoring spring to prestress the solenoid plunger into a starting position, the starting position being the open position of the solenoid valve, in which open position the solenoid plunger holds the closing element away from the valve seat.

5. The solenoid valve as claimed in claim 4, wherein the restoring spring is arranged wholly within the pole piece bore.

6. The solenoid valve as claimed in claim 1, wherein the solenoid valve is configured as a volumetric flow regulating valve.

7. The solenoid valve as claimed in claim 1, wherein the solenoid valve is part of a high pressure fuel pump.

8. The solenoid valve of claim 5, wherein the restoring spring surrounds at least part of the stop pin in the pole piece bore.

9. The solenoid valve of claim 1, the stop pin is neither directly connected to nor part of the solenoid plunger, and the stop pin is neither directly connected to nor part of the valve seat.

10. A high pressure fuel pump for a fuel injection system of an internal combustion engine, comprising:

a solenoid valve, the solenoid valve comprising:

a valve region with a closing element and a valve seat which interact in order to close the solenoid valve;

an actuator region with a control pin for moving the closing element along a movement axis into an open or closed position, the actuator region having a stationary pole piece with a pole piece bore which is arranged in the pole piece, and a solenoid plunger which is movable relative to the pole piece along the movement axis and is arranged with a pole piece end in the pole piece bore in a contactless manner with respect to the pole piece, the solenoid plunger forming the control pin;

a stop limiting movement travel of the solenoid plunger along the movement axis, the stop configured on the solenoid plunger; and a restoring spring configured to prestress the solenoid plunger into a starting position, the starting position corresponding to the open position of the solenoid valve, in which open position the solenoid plunger holds the closing element away from the valve seat, wherein the restoring spring is arranged wholly outside of the pole piece bore and supported between an end of the pole piece and the stop.

11. The high pressure fuel pump of claim 10, wherein the valve region has a valve seat plate which forms the valve seat, the closing element being configured as a small plate which lies on the valve seat plate in the closed position of the solenoid valve, the pole piece and the small plate being arranged on opposite sides of the valve seat plate.

12. The high pressure fuel pump of claim 11, wherein the solenoid plunger is configured as a cylindrical pin which penetrates the valve seat plate with a valve seat plate end in a contactless manner.

13. The high pressure fuel pump of claim 10, wherein the stop is configured at a valve seat plate end of the solenoid plunger for interaction with the valve seat plate.

14. The high pressure fuel pump of claim 10, wherein the high pressure fuel pump comprises an inlet valve and an outlet valve, the solenoid valve comprising the inlet valve.

15. The high pressure fuel pump of claim 11, wherein the stop is disposed in an axially central portion of the plunger such that the stop does not contact the pole piece when the closing element is in the closed position and does not contact the valve seat plate when the closing element is in the open position.

16. The high pressure fuel pump of claim 10, wherein the restoring spring and the valve seat are disposed on the same side of the pole piece.

* * * * *